United States Patent [19]

Aaron et al.

[11] 4,383,855

[45] May 17, 1983

[54] CERMETS AND METHOD FOR MAKING SAME

[75] Inventors: W. Scott Aaron, Clinton; Donald L. Kinser, Brentwood; Thomas C. Quinby, Kingston, all of Tenn.

[73] Assignee: The United States of America as represented by the United States Department of Energy, Washington, D.C.

[21] Appl. No.: 249,798

[22] Filed: Apr. 1, 1981

[51] Int. Cl.[3] ..... B22F 9/16; B22F 3/00; C22C 43/00; C22C 29/00

[52] U.S. Cl. ..... 419/19; 75/0.5 BC; 75/0.5 AC; 252/640

[58] Field of Search ..... 75/0.5 A, 0.5 AA, 0.5 AB, 75/0.5 AC, 0.5 B, 0.5 BA, 0.5 BB, 0.5 BC, 200, 206, 211, 224, 230, 232; 423/11-15, 42, 50, 55, 81; 252/628, 640

[56] References Cited

U.S. PATENT DOCUMENTS 4,072,501 2/1978 Quinby ..... 75/0.5 BC

FOREIGN PATENT DOCUMENTS 796489 5/1955 United Kingdom .

OTHER PUBLICATIONS

ORNL/TM-6404, "Cermet High Level Waste Forms", W. S. Aaron et al., ORNL, Oak Ridge, TN, (1978).

*Cermets*, J. R. Tinklepaugh, Reinhold Publishing Company, N.Y., (1960), pp. 54–55.

*Fundamental Principles of Powder Metallurgy*, W. D. Jones, Edward Arnold Publishers, London, (1960), p. 468.

*Primary Examiner*—Brooks H. Hunt
*Assistant Examiner*—Anne Brookes
*Attorney, Agent, or Firm*—Clay C. Carter; Stephen D. Hamel; Richard G. Besha

[57] ABSTRACT

The present invention is directed to a method for making a wide variety of general-purpose cermets and for radioactive waste disposal from ceramic powders prepared from urea-dispersed solutions containing various metal values. The powders are formed into a compact and subjected to a rapid temperature increase in a reducing atmosphere. During this reduction, one or more of the more readily reducible oxides in the compact is reduced to a selected substoichiometric state at a temperature below the eutectic phase for that particular oxide or oxides and then raised to a temperature greater than the eutectic temperature to provide a liquid phase in the compact prior to the reduction of the liquid phase forming oxide to solid metal. This liquid phase forms at a temperature below the melting temperature of the metal and bonds together the remaining particulates in the cermet to form a solid polycrystalline cermet.

8 Claims, No Drawings

CERMETS AND METHOD FOR MAKING SAME

This invention was made as a result of a contract with the U.S. Department of Energy.

BACKGROUND OF THE INVENTION

This invention relates generally to the ceramic arts and more particularly, to the art application of cermets of high mechanical integrity and retentivity in commercial quantities for industrial and nuclear applications.

Cermets have been previously produced by utilizing a variety of processes under numerous operating conditions which have been adequate for small-scale production. However, these processes have not been suitable for efficient and economic manufacturing of cermets. The desirable mechanical and thermal properties of cermets have created a widespread demand for cermets in various areas such as in the manufacture of machine tools, structural materials, turbine components, valves, ejectors, electrical contacts, bearings, and nuclear-related applications.

The problem of meeting this increasing demand for cermets has been further complicated by the recent short supply and high prices of cobalt, tungsten, and tantalum; the traditional metal "cements" used in the manufacture of cermets. The possible substitution of these alloys with more readily available and less expensive bonding or cementing agents such iron, nickel, molybdenum, aluminum, copper, lead, and tin appears attractive. However, a simple cost-effective process for their incorporation into cermets on a commercial scale has not been previously developed.

The process of the present invention significantly reduces or obviates the aforementioned problem by utilizing a liquid-phase sintering procedure to form cermets of satisfactory metallographic quality in high density. The liquid-phase sintering is accomplished at a commercial scale by using a continuous spray calcination of a urea-dispersed metal solution to produce calcined powders containing the metal oxides which can be, or which are usable in the reduction and liquid-phase sintering operation.

OBJECTS OF THE INVENTION

It is an object of the invention to provide a process for producing cermets on a commercial scale in an economic and efficient manner. The further object of the present invention is to provide a process for fabricating cermets by controlled liquid-phase sintering through the selective manipulation of reduction of metal oxide values and temperature increases during their reduction and their sintering to various metal forms in a reducing atmosphere. The still further object of the present invention is to provide a process amenable to the remote controlled manufacturing of cermets containing radioactive waste in such a manner as to sufficiently immobilize the waste for enabling the storage thereof over extensive time periods. Additional objects, advantages, and novel features of the process and the cermet article of invention will become apparent to those skilled in the ceramic arts on their examination of the following description or may be gleaned by the practice of the invention. The objectives and advantages of the invention may be realized and attained by means of the steps and procedures particularly pointed out in the appended claims.

SUMMARY OF THE INVENTION

The above and other objects of the invention are satisfied generally by employing a process providing for the reduction and liquid-phase sintering of a calcined powder compact in which at least one metal oxide is capable of being reduced to a liquid phase at an effective temperature in a suitable reducing gas environment wherein a dense compact is obtained in which the remaining oxide and other particulate values, if any, in the starting material are tightly encapsulated. More specifically, the invention is directed to a method for fabricating a cermet comprising: forming a particulate compact containing a plurality of metal oxides at least one of which is characterized by being more readily reducible to metal than at least one other metal oxide in the compact when the compact is exposed to an effective concentration of a reducing gas at elevated temperatures over a selected time period. The compact is confined in the environment containing the effective concentration of reducing gas and then heated to a temperature less than the eutectic temperature of any of the metal oxides in the compact. This temperature is maintained at less than the eutectic temperature until said at least one more readily reduced oxide is at a suboxide value having a melting temperature greater than the eutectic temperature. The temperature is then increased to a level greater than the eutectic temperature and less than the melting temperature of a metal produced by the reduction of said at least one more readily reduced metal oxide for converting the suboxide value to a liquid phase having sufficient fluidity to envelope particulate material remaining in the compact. The heating is maintained at the increased level for continuing the reduction until the liquid phase solidifies to metal.

The particulate compact subjected to the aforementioned reduction and sintering steps is preferably prepared by the spray calcination of molten urea solutions containing dissolved or suspended metal and waste values. The resulting calcined powder is cold pressed into a suitable compact configuration for sintering purposes.

Utilization of the coprecipitation and calcination steps afforded by the spray calcination of the urea solutions together with the liquid phase sintering of the resulting calcined powders provide for production of various cermets on a commercial scale and in an efficient, cost-effective manner.

DETAILED DESCRIPTION

In accordance with the present invention a compact formed of a mixture of calcined powders, preferably prepared by continuous spray calcination of a urea-dispersed solution, is subjected to a reduction and sintering operation wherein at least one metal oxide which is more readily reduced than the remaining oxides of the compact forms a liquid phase when reduced to a selected suboxide or substoichiometric value under an operative reduction environment and temperature to produce a dense compact in which the remaining particulate materials in the compact are tightly encapsulated.

Concentrations of oxides, metals, and impurities, such as radioactive wastes in a cermet prepared according to our invention may vary in a wide range of about 1 to 75 wt.% of the resultant cermet. Virtually, the oxide of any metal such as iron, nickel, copper, molybdenum, lead, and tin, may be added in the subject invention to facilitate the formation of solid, polycrystalline bodies resulting from the liquid-phase sintering of the ceramic materials. These added metals are primarily used for the formation of the oxide which results or provides for the liquid-phase sintering of the remaining particulate in the material in a cermet. However, if the starting material contains a metal which has the capability of providing a more readily reducible oxide for liquid-phase sintering purposes, the addition of these metals may be minimal or eliminated. The cermets formed by practicing the present invention have a sintered density in excess of about 95% of theoretical density with a minor amount of microscopic porosity of less than about 5%. The particulate material in the cermet is microencapsulated to ensure integrity of the cermet.

Compacts of calcined powder such as formed by the preferred continuous coprecipitation and spray calcination process, as will be described below, or by a known batch-type process such as described in U.S. Pat. No. 4,072,501 are fabricated into cermets by practice of the reduction sintering steps of the present invention. To practice this invention, compacts of calcined powder are confined in a furnace capable of confining or retaining an atmosphere of a reducing gas in a controlled concentration and which is capable of heating the compacts to a temperature sufficient to effect the liquid phase sintering of the compacts. Effective reducing gas concentrations range from about 1 to 100 percent. With the furnace containing a reducing atmosphere such as hydrogen gas, carbon monoxide, or like reducing gases, and mixtures thereof, the compact is heated at a rate wherein the reduction of the metal oxides is such that one or more of the more readily reducible oxides reaches a suboxide state at a temperature greater than the eutectic temperature of the particular oxide before the reduction of the more readily reducible oxide or oxides is complete to metal. When the temperature of the compact is increased or reaches a level greater than the eutectic temperature, the suboxide is converted to a liquid phase which flows through the compact and encapsulates the remaining metal oxides or other particulate material remaining in the compact. Upon continued heating the liquid phase becomes solid as it essentially reaches the solidus line in an appropriate phase diagram in the approach to complete reduction of the metal. The maximum temperature utilized for the liquid sintering in the subject process is above the eutectic temperature for the most readily reduced oxide or oxides and below the melting temperature of the metal or metals produced by reducing these oxides. For example, in the case of typical radioactive waste cermets this temperature is at a range of about 1300° to 1500° K.

The heating of the compacts is such that the temperature of the compact is continually increased during the reduction of the oxides in a cermet to metal. The particular rate selected is one which will drive the compact into the liquid suboxide range, above the eutectic temperature of the more readily reduced oxide or oxides in the compact, when the compact is in a substoichiometric or suboxide value which will enable the suboxide to sufficiently liquify to effect the liquid-phase sintering.

It has been found that if the calcined powders of the compact contain a relatively high proportion of readily reducible oxides, then only a minor amount of liquid phase is necessary to "cement" the compact and to prevent metal from escaping the compact and consequent loss of shape. In such an instance, the temperature increase for the compact can be relatively rapid upon reaching the liquid phase to complete the reduction to metal to ensure the attainment of only a sufficient quantity of liquid phase for affecting the desired encapsulation and sintering of the compact. When the percentage of the readily reducible oxides is relatively low in the compact, then a relatively larger fraction of the reducible oxide must be converted to the liquid phase to effect the liquid-phase sintering operation due to the presence of a greater quantity of the less readily reducible oxides and other particulate materials. In order to control the quantity of liquid phase which is dependent upon the composition of the initial oxide mixture and variably upon the utilization of the cermet, the temperature, the rate of temperature increase, and the reducing gas composition can be selectively varied to provide the desired proportion of liquid phase in the cermet, mainly by affecting the path through the liquid-containing phase region of an appropriate phase diagram.

The heating schedules utilized in the process are fairly rapid as compared to the prior-art process in that the heating rate of about 500° to 1,000° C. per hour is satisfactory for most oxide systems for effecting the necessary formation of the liquid phase and the solidification of the liquid phase upon the reduction of the liquid-phase forming oxide to metal. However, for each oxide system, the heating schedule is necessarily adjusted to ensure that the substoicheometric oxide is achieved at a eutectic temperature prior to driving the temperature above the eutectic temperature line to form the liquid phase.

The present invention provides a process in which the sintering of the compacts can be achieved in less than about four hours for the most complex oxide systems, and normally about only thirty minutes for the fairly simple oxide systems. This time period compares very favorably with the approximately twenty-four hour period required by the prior art processes for effecting the desired formation of the cermets so as to lend further surprise to the efficiency and cost effectiveness of the present invention.

As briefly pointed out above, the cermets of the present invention may incorporate radioactive waste in quantitites up to from 1 to about 75 wt.% without deleteriously affecting the cermet quality. In making radioactive waste cermets, compositional adjustments to the urea heavy-metal bearing admixture may be necessary to ensure the formation of a desired metal matrix and ceramic phases to provide the cermet with high density, thermal conductivity, mechanical integrity, self-shielding properties, and resistance to corrosion or leaching. Further, compositional adjustments may include the addition of iron, nickel, copper, molybdenum, tin, lead, and the like for providing sufficient oxide for the liquid-phase sintering operation to assure that the particulate material, including nonreduced oxides, metals, and other impurities that are present in radioactive waste, is microencapsulated within the cermet. It may be also desirable to adjust the ceramic portion of the cermet to include additives such as the oxides of zirconium, titanium, aluminum, silicon, phosphorus, manganese, barium, and calcium. These oxides are precursors to the formation at elevated temperatures of known fission product immobilizing and retentive phases, such as: hollandite, perovskite, zirconolite, nepheline, monazite, fluorite, spinel, leucite, pollucite, scheelite, opatite, and kalsilite. See, for example, Ringwood, A. E., et al, "The SYNROC Process: A Geochemical Approach To Nuclear Waste Immobilization," Geochem. J., 13, pp. 141–165 (1979); and Boatner, L. A., et al, "Monazite and Other Lanthanide Orthoposphates as Alternate Actinide Waste Forms," *The Scientific Basis for Nuclear Waste Management,* Vol. II, C. J. Northrup, Ed., Plenum Press, New York, New York (1980).

Of course, the inclusion of these additives for compositional adjustments will reduce the amount of radioactive wastes loading that can be accomplished by our cermet fabrication method. Routinely, the radioactive waste will contain sufficient amounts of iron, nickel, copper, and the like, as structural corrosion products, to form cermets of the desired properties without any, or only trace amounts of, liquid-phase forming or metal matrix additives. Thus, the predominant portion of the additives will be the precursors of the ceramic phases with their weight percents varying in direct proportion to the fisison product activity of the radioactive waste.

As briefly pointed out above, we have found it to be advantageous to form the calcined powder by coprecipitation and spray calcination of the urea-heavy metal bearing admixture in a single unit operation in a continuous manner. Since the coprecipitation and calcination steps can be performed more rapidly than in batch-type operations, a significant reduction in urea consumption is realized. An ultrasonic pulsed air injection system is preferably used for the dispersal of the highly viscous, dense solutions present in molten urea. These droplets of precipitate are uniform in size, spheroidal in configuration, and are quickly calcined to metal oxides of a size of range of about 1 to 10 microns in diameter. Heavy metal values which may include one or more of the aforementioned additive metals are mixed with a molten urea solution maintained at about 132° C. which is the urea melting point. Sources of these heavy metal values include industrial effluents, radioactive wastes, purified or scrap metals, and aqueous solutions prepared for the purpose of providing a liquid feed. The feed source for admixture with the urea solution may be either liquid or dry since dissolution and suspension properties of molten urea solutions are well known.

Spray calcination has previously been suggested as a means of reducing the urea consumption, but it was not expected that a urea-to-nitrate solution concentration ranging from about 45:1 to 5:1, as in typically known applications, could be reduced to a 1:1 molar ratio as achieved in the continuous coprecipitation and spray calcination process described herein. Excess urea was heretofore considered necessary to slow and control the reaction rate of batch urea-nitrate decompositions in coprecipitation processes of heavy metal values. The continuous coprecipitation and spray calcination of the subject process perform a more rapid reaction rate for the urea-admixture decomposition than previously attainable, thereby achieving a highly exothermic calcining condition within the enclosed spray calcination zone. The exothermic nature of the reaction provides for the calcination of the particulates at a lower furnace temperature than previously attainable to accomplish the production of metal oxide powders. For example, typical calcination temperatures range from about 800° to 1,000° C. for forming calcined powders from radioactive waste. We have found that the lower temperatures and oxidizing conditions maintained within the calcination zone inhibit vapor pressure which may result in the release of volatile species such as Ru, Cs, and Sr by holding them in low, metal or metal oxide, valent states. Other off gasses from the calcination operation consist of decomposition products of urea and aqueous solutions. These gases are relatively easily handled by conventional recovery and treating processes.

Numerous techniques have been previously utilized for preparing green compacts from mixtures of ceramic and calcined powders wherein any desired configuration such as rods, discs, cylinders, pellets, or other forms may be obtained by compaction, extrusion, or slip-casting. We have found cold pressing of the calcined powders with a water binder to be compatible with industrial processes for a commercial-scale production in accordance with the present invention particularly with respect to fabricating radioactive waste-containing cermets.

In order to further illustrate and demonstrate the effectiveness of the present invention, a typical manufacturing operation is set forth below. A simulated thorex waste solution, such as obtained from Nuclear Fuel Services-type thorex waste, was prepared by admixing iron, nickel, copper, cobalt, and thorium in a dilute nitric acid. This admixture was concentrated by sufficient heating to drive off water. This solution was then contacted with molten urea and precipitated at above 180° C. The recovered precipitate was then calcined at 800° C. to provide an admixture of various calcined powders. These powders were mixed with a water binder and cold pressed into a green pellet of a size in a range of about 10×10 mm. This pellet was placed in a furnace under hydrogen atmosphere and heated from room temperature to a temperature of about 1500° K. over a fifteen minute period. During this heating, the selected oxide mixture in the pellet was sufficiently reduced to a substoichiometric or suboxide value to provide the liquid phase necessary for sintering the remaining particulate material when the temperature increased to a level greater than the eutectic temperature of approximately 1300° K. The sintered pellet was removed from the furnace and cooled to room temperature in a reducing atmosphere. The resulting article was examined and found to be structurally sound and shock resistant. Metallographic examination revealed that all oxide particles were tightly encapsulated within a uniformly dispersed continuous metal matrix.

While the above example and description are directed to the use of a hydrogen atmosphere for effecting the reduction of metal oxides, it will appear clear that the reducing atmosphere may be a combination of hydrogen with other reducing gases such as carbon monoxide to effect desired reduction. Further, the concentration or partial pressure of the reducing gas in the furnace may be selectively varied to control the rate of reduction during a heating operation. Controlled concentrations of reducing gas may vary from about 1 to 100 percent. In any event, it is necessary that the reduction of the more reducible oxide utilized for forming the liquid phase be such that when the substoichiometric oxide enters the phase region where a liquid is generated, sufficient proportions of the liquid phase are formed when the temperature of the compact is increased above the eutectic temperature to effect satisfactory liquid-phase sintering.

It will be seen that the present invention provides a commercial-scale process for manufacturing cermets useful in many industrial and nuclear applications. It is believed that by utilizing the aforementioned continuous coprecipitation and spray calcination process, together with the liquid phase sintering operation, cermets can be manufactured in a manner considerably more efficient, and cost effective than previously known.

We claim:

1. The method for fabricating a cermet comprising:

forming a particulate compact containing a plurality of metal oxides at least one of which is characterized by being more readily reducible to metal than at least one other metal oxide in the compact when the compact is exposed to an effective concentration of a reducing gas at elevated temperatures over a selected time period;

confining the compact in an environment containing a concentration of reducing gas;

heating the compact at less than the eutectic temperature of any of the metal oxides in the compact;

maintaining said temperature at less than said eutectic temperature until said at least one more readily reduced oxide is at a suboxide value having a melting temperature greater than said eutectic temperature and thereafter increasing the temperature to a level greater than said eutectic temperature and less than the melting temperature of said metal produced by the reduction of said at least one more readily reduced metal oxide; and converting sufficient portions of the suboxide value to a liquid phase having sufficient fluidity to envelope particulate material remaining in said compact and maintaining the temperature at said increased level for continuing a reduction until the liquid phase solidifies to metal.

2. The method of claim 1 wherein the metal oxides are prepared by a continuous spray calcination of a urea-dispersed solution containing at least one metal value at a temperature of about 800°–1000° C.

3. The method of claim 1 wherein the more readily reducible oxide is selected from an oxide of at least one of the group of metals consisting essentially of iron, nickel, molybdenum, copper, lead, and tin.

4. The method of claim 1 wherein the selected time period is less than about 4 hours.

5. The method of claim 1 wherein the effective reducing gas concentration is within the range of about 1 to 100%.

6. The method of claim 1 wherein the reducing gas is hydrogen, carbon monoxide, or mixtures thereof.

7. The method of claim 1 wherein said plurality of metal oxides contain at least one non-radioactive metal oxide and at least one radioactive metal oxide value, said oxide value ranging from about 1 to 75 wt.% of the resultant cermet.

8. The method of claim 2 wherein said urea-dispersed solution contains radioactive metal values and values of a non-radioactive metal.

* * * * *